US006846373B2

(12) United States Patent
Takayama et al.

(10) Patent No.: US 6,846,373 B2
(45) Date of Patent: Jan. 25, 2005

(54) GAS-GENERATING COMPOSITIONS

(75) Inventors: Shinsuke Takayama, Aichi-ken (JP); Kazuya Serizawa, Aichi-ken (JP); Katsuhiko Takahashi, Aichi-ken (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 10/027,136

(22) Filed: Dec. 26, 2001

(65) Prior Publication Data

US 2002/0121321 A1 Sep. 5, 2002

(30) Foreign Application Priority Data

Dec. 27, 2000 (JP) ..... 2000-397718

(51) Int. Cl.[7] ..... C06B 31/28; C06B 31/02; C06B 29/22

(52) U.S. Cl. ..... 149/46; 149/61; 149/76

(58) Field of Search ..... 149/46, 76, 61

(56) References Cited

U.S. PATENT DOCUMENTS 6,019,861 A * 2/2000 Canterberry et al. ..... 149/19.1
6,024,812 A 2/2000 Bley et al.
6,231,702 B1 5/2001 Blomquist
6,368,432 B2 * 4/2002 Serizawa et al. ..... 149/46

FOREIGN PATENT DOCUMENTS

| | | |
|---|---|---|
| JP | 2000-169276 | 6/2000 |
| WO | WO 95/04710 | 2/1995 |

* cited by examiner

*Primary Examiner*—Aileen B. Felton
(74) *Attorney, Agent, or Firm*—Robert D. Buyan; Stout, Uxa, Buyan & Mullins, LLP

(57) ABSTRACT

A gas-generating composition having superior gasification rate, appropriate combustion rate, and suppressed carbon monoxide generation. The gas-generating composition includes ammonium nitrate, metal oxyacid salt, ammonium perchlorate, and combusting component. A basic combustion residue derived from the metal oxyacid salt is neutralized by hydrogen chloride derived from the ammonium perchlorate, thereby substantially neutralizing combustion residue of the gas-generating composition.

15 Claims, No Drawings

GAS-GENERATING COMPOSITIONS

BACKGROUND OF THE INVENTION

The present invention relates to gas-generating compositions, more specifically to gas-generating compositions used in a gas-generating apparatus for expanding air bag of vehicle or in a passenger-protecting apparatus, such as a pretensioner device that takes up a seat belt.

Recently, safer non-azide gas-generating compositions are researched and developed, in place of gas-generating compositions that comprise mainly of inorganic azide compounds, such as sodium azide having hazardous properties. Specifically, gas-generating compositions having a high gasification rate can achieve a decrease in size and weight of the gas-generating apparatus since the loading amount of gas-generating compositions to the gas-generating apparatus is reduced. Recently, gas-generating compositions having gasification rate exceeding 90% are required.

If the influence on the passengers is considered, the combustion residue of the gas-generating compositions is preferably substantially neutral. Gas-generating compositions are required to produce little or no carbon monoxide.

Ammonium nitrate has drawn attention as an oxidant for non-azide gas-generating composition. Ammonium nitrate has the advantages that it does not produce a hazardous gas or a combustion residue, is low in toxicity, and it is relatively safe. However, ammonium nitrate lowers the combustion rate of gas-generating composition when used as an oxidant. Accordingly, in order to improve combustion rate of gas-generating composition, metal oxyacid salt, such as potassium nitrate, sodium nitrate and strontium nitrate, is added. Further, the volume of ammonium nitrate changes along with phase transition. Potassium oxyacid salt, such as potassium nitrate, is added to prevent degradation of gas-generating composition form.

Oxyacid salts of transition metals are generally inappropriate because they have properties difficult to handle (deliquescence, toxicity, low thermal stability) Therefore, oxyacid salts of alkali metals or alkali earth metals are used. Oxyacid salts of alkali metals and alkali earth metals have a problem in that they release strong basic combustion residue outside the gas-generating apparatus, after combustion.

PCT-based Japanese Patent Application Laid-Open No. Hei 9-503194 discloses a conventional gas-generating composition containing phase-stabilized ammonium nitrate as the main component, triamino guanidine nitrate, and organic polymer binder. Japanese Patent Application Laid-Open No-2000-169276 discloses a conventional gas-generating composition comprising phase-stabilized ammonium nitrate, nitroguanidine, and oxygen-containing potassium salt. However, a large amount of the basic combustion residue (potassium hydroxide and potassium carbonate) is released after the combustion in conventional gas-generating compositions.

BRIEF SUMMARY OF THE INVENTION

An object of the present invention is to provide gas-generating composition which has a large gasification rate in combustion and an appropriate combustion rate, and in which generation of a basic combustion residue and carbon monoxide is reduced.

To achieve the above object, the present invention provides a gas-generating composition including ammonium nitrate, metal oxyacid salt which produces a basic substance in combustion, ammonium perchlorate, and at least one kind of combusting component selected from the group consisting of polymer binder, energetic material, and microcrystalline carbon powder. The ammonium nitrate constitutes between 50 and 97 weight % of the sum of the ammonium nitrate, the metal oxyacid salt, and the ammonium perchlorate.

Other aspects and advantages of the present invention will become apparent from the following description, taken in conjunction with the accompanying drawings, illustrating by way of example the principles or the invention.

DETAILED DESCRIPTION OF THE PREFERRED EMBODIMENT

An embodiment of the invention is described in detail below.

A gas-generating composition of the invention includes four essential components: (a) ammonium nitrate, (b) metal oxyacid salt which produces a basic substance in combustion, (c) ammonium perchlorate, and (d) at least one kind of combusting component selected from the group consisting of polymer binder, energetic material, and microcrystalline carbon powder. The weight of ammonium nitrate with respect to the total weight of the ammonium nitrate, the metal oxyacid salt, and the ammonium perchlorate is preferably between 50% and 97 weight %, Ammonium nitrate is a major oxidant composition of the gas-generating composition. Ammonium nitrate has low toxicity and is completely gasified when combusted. Because the amount of hazardous gas and combustion residues produced after combustion is low, it is one of the most desirable oxidants.

Ammonium nitrate is preferably in powder form, from the aspect of mixing property with other components in the gas-generating composition and the combustion rate of the gas-generating composition. A preferable range or average particle size of the ammonium nitrate powder is between 1 and 1000 $\mu$m. On considering the mechanical properties and the combustion rate of the formed gas-generating composition, the average particle size is preferably in the range between 2 and 200 $\mu$m. If the average particle size of the ammonium nitrate powder is less than 1 $\mu$m, the manufacture of the gas generating composition is difficult. On the other hand, if the average particle size of the ammonium nitrate powder exceeds 1000 $\mu$m, the mechanical properties of the formed gas generating composition is low, and the combustion rate is slow.

Ammonium nitrate is preferably phase-stabilized. Since the volume change due to phase transition is suppressed in phase-stabilized ammonium nitrate, the property changes in the gas generating composition are reduced.

The metal oxyacid salt, which produces a basic substance in combustion, improves the combusting property of the gas generating composition. Any known metal oxyacid salts for a gas generating composition can be used as the metal oxyacid salt. For example, oxyacid salts of transition metals, alkali metals, and alkali earth metals can be used. When deliquescence, toxicity, and thermal stability are considered, alkali metal nitrate, alkali metal nitrite, alkali earth metal nitrate, and alkali earth metal nitrite are preferable. Further, nitrates of potassium, sodium, and strontium are specifically preferable. The thermal stability required to the components of the gas-generating composition is that it neither melts nor decomposes within the practical temperature range of the gas-generating composition.

The metal oxyacid salt is preferably in powder form, from the aspect of formability and combustibility. The average particle size of the metal oxyacid salt is preferably between 1 and 1000 μm. The average particle size is preferably between 2 and 200 μm, if the mechanical properties and the combustion rate of the gas-generating composition are considered. If the average particle size is less than 1 μm, the manufacture of the gas generating composition is difficult. On the other hand, if the average particle size exceeds 1000 μm, the mechanical properties of the formed gas generating composition are poor, and the combustion rate is slow.

The metal oxyacid salt is preferably a potassium salt, specifically potassium nitrate, based upon the improvements in combustibility of the gas-generating composition, and the phase-stability effect of ammonium nitrate. Compounding amounts of the potassium salt with respect to the phase-stabilized ammonium nitrate can be appropriately modified, in a range in which phase-stabilizing effect occurs, and in which a combustion residue is not a practical problem. For instance, in the case where the ammonium nitrate is phase-stabilized by means of potassium nitrate, the ammonium nitrate is preferably between 70 and 98 weight %, and the potassium nitrate is between 2 and 30 weight %. It is more preferable that the ammonium nitrate is between 75 and 96 weight % and the potassium nitrate is between a and 25 weight %.

The phase-stabilized ammonium nitrate is manufactured through an appropriate physical method. For example, the phase-stabilized ammonium nitrate can be obtained by heating mixed aqueous solution of ammonium nitrate and an amount of potassium nitrate, and then drying the ammonium nitrate through evaporation of water.

The phase-stabilized ammonium nitrate is preferably in a powder form, from the aspect of mixing property and combustibility. The average particle size of the ammonium nitrate is preferably in the range between 1 and 1000 μm. The average particle size is preferably in the range between 2 and 200 μm if the mechanical properties and the combustion rate of the gas-generating composition are considered. If average particle size is less than 1 W, the manufacture of the gas-generating composition is difficult. On the other hand, if the average particle size exceeds 1000 μm, the mechanical properties of formed gas generating composition is low, and the combustion rate is slow.

The ammonium perchlorate chemically neutralizes the basic substance produced from μm metal oxyacid salt in combustion of the gas-generating composition. In other words, the ammonium perchlorate produces hydrogen chloride (HCl) and chlorine gas through decomposition. The basic substance reacts with the hydrogen chloride and chlorine gas, and changes into a neutral alkali metal chloride or an alkali earth metal chloride. This prevents releasing a basic substance inside a vehicle.

For example, if the metal oxyacid salt is potassium nitrate, a neutral chloride is formed, by neutralizing the combustion residue of potassium and a strong basic substance, such as metal hydroxide and metal carbonate, with the ammonium perchlorate. This reduces the strong basic combustion residue.

Since ammonium perchlorate has a relatively large gasification rate, the amount of produced combustion residue is small. Accordingly, the gas-generating composition that includes ammonium nitrate and ammonium perchlorate produces little or no combustion residues. As described above, ammonium perchlorate does not impair the advantage of high gasification rate of ammonium nitrate. The combustion rate of the gas-generating composition is effectively improved because the ammonium perchlorate also acts as an oxidant.

The ammonium perchlorate is preferably in a powder form, from the aspect of the mixing property and the combustion rate. The average particle size is preferably in the range between 1 and 1000 μm. It is preferably in the range between 2 and 200 μm if the mechanical properties and the combustion rate of the gas-generating composition are considered. If the average particle size is less than 1 μm, the manufacture of the gas-generating composition is difficult. On the other hand, if the average particle size exceeds 1000 μm, the mechanical properties of formed gas generating composition is low, and tho combustion rate is slow.

The combusting component includes at least one selected from the group consisting of polymer binder, energetic material, and microcrystalline carbon powder.

Examples of polymer binders that can be used include polyvinyl polymers, cellulose polymers, polyester polymers, polyurethane polymers, polyether polymers, thermoplastic elastomers, polyacrylic polymers, polyamides, polyimides, ketone resin, melamine resin, urea resin, polysaccharides, rubbers, and energizing compound binders.

Examples of useful polyvinyl polymers include polyvinyl alcohol, polyvinyl butyral, polyvinyl ether, polyvinyl acetal, polyvinyl formal, polyvinyl pyrrolidone, and carboxyvinyl polymer.

Examples of useful cellulose polymers include acetylcellulose, cellulose acetate butyrate, nitrocellulose, cellulose acetate nitrate, cellulose nitrate carboxymethyl ether, carboxymethyl cellulose and its salt, hydroxymethyl cellulose, hydroxyethyl cellulose, ethylcellulose, hydroxy propylcellulose, methylcellulose, and crystalline cellulose.

Polyester polymers include polyester synthetic fiber, polyethylene telephthalate, and unsatured polyester resin Polyurethane polymers include urethane resin. Polyether polymers include polypropylene oxide, polyphenylene oxide, and polyether imide. Thermoplastic elastomers include polyurethane elastomer and polyester elastomer. Polyacrylic polymer include polyacrylic amide and the derivatives, polyacrylic hydrazide, polyacrylate, polyacrylate derivatives, polymethacrylate Polyamides include Nylon 6, Nylon 66, Nylon 610, Nylon 612, Nylon 11, Nylon 12, Nylon 46, copolymer polyamide, methoxymethyl amide. Polysaccharides include soluble starch, guar gum, pectin, chitin, and their derivatives. Rubbers include acrylic rubber, isoprene rubber, urethane rubber, silicone rubber, Viton, butadiene rubber, butyl rubber, nitrile butyl rubber, fluoro rubber. Energizing compound binders include glycidyl azide polymer, 3,3-bis(azide methyl)-oxetane polymer, 3-azide methyl-3-methyloxetane polymer, 3-nitrate methyl-3-methyloxetane polymer.

The polymer binder can be used merely as a combusting component, or as both of a binder in extrusion molding of the gas generating composition and a combusting component. An appropriate polymer binder for extrusion molding is acetylcellulose, considering solubility to solvents, thermal stability, ease of handling, and combustion rate.

Examples of a useful energetic material are RDX (trimethylene trinitroamine), HMX (tetramethylene tetranitroamine), PETN (pentaerythritol tetranitrate), TAGN (triamino guanidine nitrate), RN (hydrazine nitrate), and NQ (nitroguanidine).

Examples of a useful microcrystalline carbon are activated carbon, charcoal, animal charcoal, and carbon black. In order to improve combustion rate, activated carbon and charcoal are preferable.

Examples of a useful combusting component include mixtures of a plurality of the combusting component described above. Powder microcrystalline carbon is specifically preferable among the combusting components. This is because the microcrystalline carbon powder promotes decomposition of ammonium nitrate and has an effect in significantly improving the combustion rate of the gas generating composition.

If the combusting component is in powder form, the average particle size is preferably in a range between 1 and 500 μm. The average particle size is preferably in the range between 2 and 60 μm if the mechanical properties and the combustion rate of the gas-generating composition are considered. If the average particle size is less than 1 μm, the manufacture of the gas-generating composition is difficult. On the other hand, if the average particle size exceeds 500 μm, the manufacturability of the gas generating composition and the combustion rate are degraded.

The ammonium nitrate, metal oxyacid salt, and ammonium perchlorate must be compounded so that the weight of the ammonium nitrate constitutes between 50 and 97% of the total weight of the three components. Gasification rate decreases when the ammonium nitrate constitutes less than 50 weight % of the three components. When the ammonium nitrate constitutes more than 97 weight % of the three components, the combustion rate is reduced. The weight percentage of ammonium nitrate as compared to the sum of ammonium nitrate, metal oxyacid salt and ammonium perchlorate can be called the "X-value."

In the case where phase-stabilized ammonium nitrate, which is phase-stabilized by potassium nitrate, is used as the ammonium nitrate, the ammonium nitrate may not be sufficiently phase-stabilized when it exceeds 97% weight % of the three components, because the relative compounding amount of potassium nitrate within the phase-stabilized ammonium nitrate becomes lower.

Preferably, the ammonium nitrate constitutes between 54 and 92 weight % of the sum of ammonium nitrate, metal oxyacid salt, and ammonium perchlorate, considering gasification rate and combustion rate of the gas-generating composition.

If nitrate or nitrite of alkali metal is used as metal oxyacid salt, the compounding amount of ammonium perchlorate is preferably between 0.8 and 1.2 mol per mole of the nitrate or nitride of alkali metal. In other words, the molar ratio of ammonium perchlorate with respect to nitrate or nitrite of alkali metal is preferably between 0.8 and 1.2. In order to suppress generating a basic substance and hydrogen chloride due to combustion, the molar ratio is more preferably between 0.9 and 1.1. The basic substance produced from nitrate or nitrite of alkali metal is not sufficiently neutralized when the molar ratio is less than 0.8, and a strong basic substance is released inside the vehicle at high concentration. On the other hand, when the molar ratio exceeds 1.2, unreacted hydrogen chloride accompanied with the basic substance is released inside the vehicle at high concentrations.

If nitrate or nitrite of alkali earth metal is used as the metal oxyacid salt, the molar ratio of ammonium perchlorate with respect to nitrate or nitrite of alkali earth metal is preferably between 1.6 and 2.4. The molar ratio of the ammonium perchlorate is preferably between 1.8 and 2.2 in order to suppress generating a basic substance and hydrogen chloride due to combustion. A strong basic substance is released inside the vehicle at high concentration when the molar ratio is less than 1.6 mol because the base substance produced from nitrate or nitrite of alkali earth metal is not sufficiently neutralized. On the other hand, when the molar ratio exceeds 2.4 mol, unreacted hydrogen chloride produced from ammonium perchlorate is released inside the vehicle at high concentrations with the basic substance.

Preferably, the combusting component constitutes between 2 and 60 weight % of the four components (ammonium nitrate, metal oxyacid salt, ammonium perchlorate, and combusting component). Preferable, this range is between 4 and 40 weight %. If the percentage of the combusting component is less than 2 weight % of the four components, the combustion rate of the gas-generating compound is slow, and the manufacturability and performance are undesirable. If the combusting component exceeded 60 weight %, the combustion rate is low and ignitionability is not preferable. Further, since the gas-generating composition is liable to cause imperfect combustion, large amount of hazardous gases (such as unburnt materials and carbon monoxide) are produced.

If the combusting component includes energetic material, sensitivity against impact of gas-generating composition is considered. In this case, the compounding amount of the energetic material is preferably less than 15 weight % with respect to the total weight of the gas-generating composition.

A stabilizer that prevents natural decomposition of the gas-generating composition can be added in the gas-generating composition. The stabilizer improves the stability over time of the gas-generating composition. Example of useful stabilizers include diphenyl urea derivatives, such as diphenyl urea, methyl diphenyl urea, ethyl diphenyl urea, diethyl diphenyl urea, dimethyl diphenyl urea, and methyl ethyl diphenyl urea; diphenyl amine derivatives, such as diphenyl amine and 2-nitro diphenyl amine; phenyl urethane derivatives, such as ethyl phenyl urethane and methyl phenyl urethane; and diphenyl urethane derivatives, such as diphenyl urethane, and resorcinol.

The stabilizer is compounded at an amount with which the stability of the gas-generating composition over time is at a level practically durable. The amount of the stabilizer is preferably 5 weight % or less with respect to the total weight of the gas-generating composition, further preferably between 0.5 and 4.5 weight %, considering the combustion rate and that carbon monoxide is not substantially produced in the produced gas. When the compounding amount of the stabilizer exceeds 5 weight %, the amount of the other components are relatively decreased. In this case, the combustion rate of the gas-generating composition is decreased and carbon monoxide is produced.

In order to improve formability by imparting plasticity to the gas-generating composition, a plasticizer can be added to the gas-generating composition. Any compound can be used as plasticizer, given that the compound has good compatibility with polymer binder. Examples of useful plasticizers include phthalate diester plasticizers, such as dibutyl phthalate, dimethyl phthalate, and diethyl phthalate; fatty acid ester plasticizers, such as phosphate ester, triacetin, and acetyl triethyl nitrate; nitroplasticizers, such as trimethylolethane trinitrate, diethyleneglycol dinitrate, triethyleneglycol dinitrate, nitroglycerin, and bis-2,2-dinitropropyl acetal/formal; and glycidylazide plasticizers.

The compounding amount of the plasticizers is preferably less than 3 weight % with respect to the total weight of the gas-generating composition, and less than 2 weight % is specifically preferable in order that carbon monoxide is not substantially produced.

If the compounding amount of the plasticizers exceeds 3 weight %, the compounding ratio of the four components are decreased, accordingly, the combustion rate is decreased, and carbon monoxide is produced in the produced gas.

The combustion catalyst that improves combustion rate of the gas-generating composition can be added. The combustion catalyst is preferably selected from among combustion catalysts for ammonium nitrate or for ammonium perchlorate. Useful catalysts include oxides of transition metals, such as manganese dioxide, iron oxide, copper oxide, chromium oxide, cobalt oxide, and nickel oxide; metal oxides, such as aluminum oxide; ferrocene derivatives, such as ferrocene and catocene; and metal fluoride, such as lithium fluoride.

The average particle size of the combustion catalyst is preferably in a range between 1 and 500 $\mu$m, preferably let-ween 2 and 60 $\mu$m, considering the mechanical properties and the combustion rate of the gas-generating composition.

The combustion catalyst is preferably less than 10 weight % with respect to the total weight of the gas-generating composition. It is preferably 5 weight % or less, considering reduction of the combustion residue.

The gas-gonerating composition of the invention is formed in a predetermined shape, for instance by pressing using pressing machine, such as tablet machine. Alternatively, the gas-generating composition is formed in a predetermined shape by extrusion molding using an extrusion apparatus, after an organic solvent is added to the gas-generating composition and is uniformly mixed. The gas-generating composition is loaded on the gas-generating apparatus after being formed in a shape in compliance with the gas-generating apparatus.

When the gas-generating composition is formed by extrusion, the polymer binder dissolved in an appropriate organic solvent is used as the combusting component.

On the other hand, when the gas-generating composition is formed by pressing, a forming agent can be added, to enhance the strength of the formed gas-generating composition, if necessary. Examples of useful forming agents includes inorganic binders, such as alumina, silica, mica, molybdenum disulphide.

Further, when the gas-generating composition is formed by pressing, a form-facilitating agent, such as calcium stearate, magnesium stearate, zinc stearate, and molybdenum disulfide, can be added if necessary in order to perform forming process smoothly by improving flowability of the gas-generating composition.

The compounding amount of the forming agent and the form-facilitating agent are preferably 5 weight % or less with respect to the total weight of the gas generating composition, specifically, 4 weight % or less is preferable when the combustion rate of the gas generating composition is considered.

The oxygen-balance value of the gas-generating composition is preferably in a range between −0.1 and +0.1 (g/g). Further, the oxygen-balance value is preferably between −0.05 and +0.05 (g/g) in order to improve the combustion rate of the gas-generating composition and not to substantially form carbon monoxide and hazardous substances When the oxygen-balance value exceeds +0.1 (g/g), the combustion rate of the gas-generating composition is slow. When the oxygen-balance value is less than −0.1 (g/g), the combustion rate of the gas-generating composition is low, and the amount of carbon monoxide and hazardous substances produced is increased.

Oxygen balance is described next. Oxygen-balance is an index representing excess and shortage of oxygen when a substance is converted to perfect oxidation-reduction reaction products, such as $CO_2$, $H_2O$ and $N_2$. Oxygen-balance is represented by weight of oxygen in grams per gram of the substance before combustion. More specifically, the perfect combustion reaction of the substance is represented as shown below, when the molecular formula of the substance or the average molecular formula of the mixture is represented by $C_xH_yO_zN_u$.

$$C_xH_yO_zN_u \rightarrow x\cdot CO_2 + \frac{y}{2}\cdot H_2O + \frac{u}{2}\cdot N_2 - \frac{1}{2}\cdot\left(2x + \frac{y}{2} - z\right)O_2$$

Oxygen-balance (g/g) is calculated from the equation shown below.

$$\left\{-\frac{1}{2}\cdot\left(2x + \frac{y}{2} - z\right)\times 32\right\} \div$$

{molecular weight (or average molecular weight) of substance}

In the raw material of gas-generating composition, a substance which has a positive oxygen-balance value acts as an oxidant, and a substance which has a negative oxygen-balance value acts as a reductant. Substance having oxygen-balance of zero do not react in the combustion reaction. For example, the oxygen-balance value of ammonium nitrate is +0.20, ammonium perchlorate, +0.34, and microcrystalline carbon powder, −2.66.

According to the gas-generating composition of the present invention, following advantages are obtained.

Since the gas-generating composition of the invention includes ammonium nitrate and metal oxyacid salt, relatively high gasification rate of 90% or more and appropriate combustion rate ate achieved. Further, the amount of basic substance produced is reduced.

Since the gas-generating composition includes at least one metal oxyacid salt selected from the group consisting of alkali metal nitrate, alkali metal nitrite, alkali earth metal nitrate, and alkali earth metal nitrite, the gas-generating composition has low toxicity, has high thermal stability and is not liable to cause deliquescence. Therefore the gas-generating composition of the invention is easy to handle.

The amount of basic substance produced is appropriately reduced, because the molar ratio of the ammonium perchlorate with respect to nitrate and nitrite of alkali metal is between 0.8 and 1.2, or the molar ratio of the ammonium perchlorate with respect to nitrate and nitrite of alkali earth metal is between 1.6 and 2.4.

The amount of the combusting component, relative to other components being appropriately set, the gas-generating composition is combusted at an appropriate combustion rate, and incomplete combustion is prevented, thereby suppressing unburnt substances.

Phase-transition of ammonium nitrate is suppressed because the ammonium nitrate is phase-stabilized. As a result, performance changes of the gas-generating composition accompanied by volume change of ammonium nitrate are suppressed.

By using a gas-generating composition which includes the stabilizer, natural decomposition of the gas-generating composition is suppressed. Accordingly, the initial performance of the gas-generating composition is maintained over time under the condition of being loaded on a vehicle.

Since the oxygen-balance value of the gas-generating composition is between −0.1 and +0.1 (g/g), imperfect combustion is prevented, and as a result, generation of carbon monoxide and hazardous substances is suppressed.

EXAMPLES

The invention is described in more detail by referring to Examples and Comparative Examples below. Note that the symbol "%" represents weight percentage unless otherwise stated.

The gas-generating compositions of Examples 1 through 3, 6 and 7, and Comparative Examples 1, 2, 4, 5, and 6 through 9 include phase-stabilized ammonium nitrate and potassium nitrate. The preparation steps of phase-stabilized ammonium nitrate is described below.

Ammonium nitrate and potassium nitrate are dissolved in aqua distillata. The aqueous solution is heated in a water bath of approximately 90° C., and water is evaporated. Phase-stabilized ammonium nitrate is obtained by completely removing water through suction drying. Phase-stabilized ammonium nitrate is used having an average particle size is 125 $\mu$m, and having passed a screen having 100 mesh.

Compositions, gasification rates, combustion rates, pas of the combustion residues and the amount of carbon monoxide produced, of gas-generating compositions according to Examples 1 through 7, are shown in Table 1. Compositions, gasification rates, combustion rates, pHs of combustion residues and carbon monoxide generation of gas-generating compositions according to Comparative Examples 1 through 9 are shown in Table 2.

Gasification rate refers to the proportion of weight of gas component with respect to the total weight of combustion products.

Combustion rate was measured as follows. A gas-generating composition formed in strand form is combusted under the pressurized condition at 7 MPa by nitrogen gas, and the combustion rate then was measured.

The pH of combustion residue was measured as follows. An inflator having gas exhaust nozzle, and in which boron/potassium nitrate for ignition charge was loaded, was prepared. A granular gas-generating composition 30 g was charged in the combustion chamber of the inflator. Inside of the inflator was pressurized to 20.6 MPa (210 kgf/cm$^2$) with argon gas. The inflator was placed in a sealed 60 liter tank. The gas-generating composition was combusted by electric ignition. The inside of the tank was washed with one liter distilled water after the test. The pH of the water after washing was measured.

Example 1

Ammonium nitrate and potassium nitrate were mixed at weight ratio of 90/10, and phase-stabilized ammonium nitrate was prepared through the method described above. Phase-stabilized ammonium nitrate, ammonium perchlorate, activated carbon, diphenyl amine and acetylcellulose were mixed. Acetone at 0.24 fold of the total weight of the mixture, and ethanol, at 0.06 fold, were added and uniformly mixed by Werner kneader, to obtain solid mass of the mixture.

The solid mixture was loaded in an extrusion apparatus attached with a dice having 5.4 mm diameter and a pin having 0.8 mm length. The solid mixture was extruded through the die by the extrusion apparatus to form an elongated body having seven penetrations. By cutting the elongated body cut in 4 mm length and by drying, a granular gas-generating composition was obtained. A solid mixture, formed into a strand, was separately prepared as a sample for measuring combustion rate.

Examples 2 through 5, Comparative Examples 4 and 5

A gas-generating composition was prepared to have compounding ratio as shown in Tables 1 and 2, through methods similar to that of Example 1.

Example 1 and 7, Comparative Examples 1 through 3, 6 through 9

Powdery mixtures having compounding ratio shown in Tables 1 and 2 were prepared. The mixtures were formed into pellets having a diameter 7 mm and a thickness 1.6 mm, by using a tableting machine. Gasification rate, pH, and amount of carbon monoxide produced were measured by using these pellets. Said solid mixture formed into a strand was separately prepared as a sample for measuring combustion rate.

As found in the results of Tables 1 and 2, the gas-generating compositions of Comparative Examples 1 through 7, in which ammonium perchlorate was not compounded, showed strong alkalinity of pH 9.5 or higher. Accordingly, it is presumed that a basic combustion residue was formed.

On the other hand, pH of around neutral was obtained in Examples 1 through 7 in which ammonium perchlorate was compounded. Therefore, the combustion residue of the metal oxides were believed to have been neutralized. It was found that the effect to passengers of a vehicle at vehicle collision was reduced according to the gas-generating composition of Examples 1 through 7.

The combustion rate of Comparative Examples 5 and 7 was significantly low, and pH was significantly high in Comparative Example 6.

As shown in Table 2, X-value (weight percent of ammonium nitrate, compared to sum of ammonium nitrate, metal oxyacid, and ammonium perchlorate) of Comparative Example 8 was 48 weight i, and X-value of Comparative Example 9 was 98 weight %. Comparative Example 8 and Example 6 were comprised of similar kinds of components. It was found that Comparative Example 8 had low gasification rate compared to Example 6. In addition, the combustion rate in Comparative Example 9 turned out to be significantly low from comparison of Comparative Example 9 and Example 6.

TABLE 1

| Example | Ref. | Composition | Weight % | X-value (weight %) | (A + B + C)/(A + B + C + D) and D/(A + B + C + D) | Forming Method | Gasification rate (%) | Combustion rate (mm/c) | OM of Combustion residue | Amount Of CO(ppm) |
|---|---|---|---|---|---|---|---|---|---|---|
| 1 | a | Ammonium nitrate | 71.23 | 80.63 | 89.99 | extrusion | 94.2 | 0.8 | 8.9 | 0 |
| | b | Potassium nitrate | 7.91 | — | | | | | | |
| | c | Ammonium perchlorate | 0.20 | — | | | | | | |
| | d | Activated carbon | 1.83 | | 10.01 | | | | | |
| | d | Acetylcellulose | 8.00 | | | | | | | |
| | e | Diphenyl amine | 1.83 | | | | | | | |
| 2 | a | Ammonium nitrate | 72.00 | 81.47 | 90.01 | extrusion | 94.2 | 0.1 | 8.3 | 0 |
| | b | Potassium nitrate | 8.00 | — | | | | | | |
| | c | Ammonium perchlorate | 9.38 | — | | | | | | |
| | d | Activated carbon | 1.81 | | 9.99 | | | | | |
| | d | Acetylcellulose | 8.00 | | | | | | | |
| | e | Diphenyl amine | 1.81 | | | | | | | |
| 3 | a | Ammonium nitrate | 70.48 | 79.80 | 89.55 | extrusion | 94.2 | 7.3 | 6.4 | 0 |
| | b | Potassium nitrate | 1.83 | — | | | | | | |
| | c | Ammonium perchlorate | 10.01 | — | | | | | | |
| | d | Activated carbon | 1.85 | | 10.04 | | | | | |
| | d | Acetylcellulose | 8.00 | | | | | | | |
| | e | Diphenyl amine | 1.85 | | | | | | | |
| 4 | a | Ammonium nitrate | 68.42 | 78.08 | 88.30 | extrusion | 93.3 | 6.1 | 6.8 | 0 |
| | b | Sodium nitrate | 7.80 | — | | | | | | |
| | c | Ammonium perchlorate | 10.52 | — | | | | | | |
| | d | Polyester Elastomer | 11.48 | | 11.70 | | | | | |
| | f | Copper oxide | 2.00 | | | | | | | |
| 5 | a | Ammonium nitrate | 70.47 | 81.00 | 99.90 | extrusion | 92.5 | 6.1 | 7.2 | 0 |
| | b | Strontium nitrate | 7.83 | — | | | | | | |
| | c | Ammonium perchlorate | 8.70 | — | | | | | | |
| | d | Polyester Elastomer | 11.00 | | 11.20 | | | | | |
| | f | Copper oxide | 2.00 | | | | | | | |
| 6 | a | Ammonium nitrate | 74.27 | 80.63 | 94.97 | press-urization | 93.9 | 10.7 | 7.1 | 0 |
| | b | Potassium nitrate | 8.25 | — | | | | | | |
| | c | Ammonium perchlorate | 9.59 | — | | | | | | |
| | d | Activated carbon | 5.20 | | 5.13 | | | | | |
| | e | Diphenyl amine | 2.53 | | | | | | | |
| 7 | a | Ammonium nitrate | 70.09 | 80.83 | 88.70 | press-urization | 97.9 | 8.0 | 7.0 | 0 |
| | b | Potassium nitrate | 7.79 | — | | | | | | |
| | c | Ammonium perchlorate | 9.05 | — | | | | | | |
| | d | Polyester Elastomer | 11.07 | | 11.30 | | | | | |
| | f | Copper oxide | 2.00 | | | | | | | |

References e and f show optionally added components, where e is a stabilizer and f is a combustion catalyst.

TABLE 2

| Comparative Example | Ref. | Composition | Weight % | X-value (weight %) | (A + B + C)/(A + B + C + D) and D/(A + B + C + D) | Forming Method | Gasification rate (%) | Combustion rate (mm/s) | pH of Combustion residue | Amount Of CO(ppm) |
|---|---|---|---|---|---|---|---|---|---|---|
| 1 | a | Ammonium nitrate | 82.00 | — | — | press-urization | 95.2 | 5.6 | 10.0 | 0 |
| | b | Potassium nitrate | 7.00 | | | | | | | |
| | d | Polyacrylic amide | 11.00 | | | | | | | |
| 2 | a | Ammonium nitrate | 82.30 | — | — | press-urization | 93.2 | 21.5 | 11.3 | 450 |
| | b | Potassium nitrate | 10.00 | | | | | | | |
| | d | Activated carbon | 7.70 | | | | | | | |
| 3 | b | Potassium nitrate | 8.00 | — | — | press-urization | 59.2 | 2.5 | 10.2 | 15080 |
| | b | Strontium nitrate | 44.00 | | | | | | | |
| | d | 5-Aminotetrazol | 32.00 | | | | | | | |
| | g | Mica | 18.00 | | | | | | | |
| 4 | a | Ammonium nitrate | 79.85 | — | — | extrusion | 93.9 | 4.5 | 11.0 | 0 |
| | b | Potassium nitrate | 8.87 | | | | | | | |
| | d | Activated carbon | 1.64 | | | | | | | |
| | d | Acetylcellulose | 8.00 | | | | | | | |
| | e | Diphenyl amine | 1.64 | | | | | | | |
| 5 | a | Ammonium nitrate | 79.95 | — | — | extrusion | 89.5 | 1.8 | 9.5 | 0 |
| | b | Potassium nitrate | 8.87 | | | | | | | |
| | d | Activated carbon | 1.04 | | | | | | | |
| | d | Acetylcellulose | 8.00 | | | | | | | |
| | e | Diphenyl amine | 1.84 | | | | | | | |
| | f | Alumina (ratio with | 5.00 | | | | | | | |

TABLE 2-continued

| Comparative Example | Ref. | Composition | Weight % | X-value (weight %) | (A + B + C)/(A + B + C + D) and D/(A + B + C + D) | Forming Method | Gasification rate (%) | Combustion rate (mm/s) | pH of Combustion residue | Amount Of CO(ppm) |
|---|---|---|---|---|---|---|---|---|---|---|
| | | respect to total amount of other components) | | | | | | | | |
| 6 | a | Ammonium nitrate | 83.26 | — | — | press-urization | 93.7 | 11.5 | 11.9 | 0 |
| | b | Potassium nitrate | 9.25 | | | | | | | |
| | d | Activated carbon | 4.99 | | | | | | | |
| | e | Diphenyl amine | 2.50 | | | | | | | |
| 7 | a | Ammonium nitrate | 83.26 | — | — | press-urization | 89.2 | 2.4 | 9.8 | 0 |
| | b | Potassium nitrate | 9.25 | | | | | | | |
| | d | Activated carbon | 4.99 | | | | | | | |
| | e | Diphenyl amine | 2.50 | | | | | | | |
| | f | Alumina (ratio with respect to total amount of other components) | 5.00 | | | | | | | |
| 8 | a | Ammonium nitrate | 43.42 | 48.01 | 93.44 | press-urization | 84.0 | 22.2 | 7.1 | 0 |
| | b | Potassium nitrate | 21.76 | | | | | | | |
| | c | Ammonium perchlorate | 25.29 | | | | | | | |
| | d | Activated carbon | 6.35 | | 6.56 | | | | | |
| | e | Diphenyl amine | 3.18 | | | | | | | |
| 9 | a | Ammonium nitrate | 91.16 | 98.00 | 95.24 | press-urization | 99.4 | 3.7 | 6.1 | 0 |
| | b | Potassium nitrate | 0.80 | | | | | | | |
| | c | Ammonium perchlorate | 1.00 | | | | | | | |
| | d | Activated carbon | 4.65 | | 4.76 | | | | | |
| | e | Diphenyl amine | 2.33 | | | | | | | |

References e, f, and g represent optionally added components, where e is a stabilizer, f is a combustion catalyst and g is a slag forming agent.

Sizes and manufacturers of the compounds of Tables 1 and 2 are as shown below.

| | |
|---|---|
| Ammonium nitrate: | average particle size 125 μm |
| Sodium nitrate: | average particle size 125 μm |
| Strontium nitrate: | average particle size 125 μm |
| Ammonium perchlorate: | average particle size 125 μm |
| Activated carbon: | average particle size 15 μm |
| Copper Oxide: | average particle size 15 μm |
| Diphenyl amine: | average particle size 125 μm |
| Acetylcellulose: | Cellulose diacetate |
| Polyvinyl alcohol: | average particle size 25 μm |
| Polyester Elastomer: | manufactured by Toyo Boseki Kabushiki Kaisha by product name "PELPRENE P-30B" |
| Alumina: | average particle size 0.3 μm |

It should be apparent to those skilled in the art that the present invention may be embodied in many other specific forms without departing from the spirit or scope of the invention. Therefore, the present examples and embodiment are not restrictive and the invention is not to be limited to the details given herein, but may be modified within the scope and equivalence of the appended claims

What is claimed is:

1. A gas-generating composition consisting essentially of:

(a) ammonium nitrate;

(b) metal oxyacid salt which produces a basic substance in combustion;

(c) ammonium perchlorate; and (d) at least one kind of combusting component selected from the group consisting of polymer binder, energetic material, and microcrystalline carbon powder, wherein the ammonium nitrate constitutes between 50 and 97 weight % of the sum of the ammonium nitrate, the metal oxyacid salt, and the ammonium perchlorate.

2. A gas-generating composition according to claim 1, wherein the metal oxyacid salt comprises at least one compound selected from the group consisting of alkali metal nitrate, alkali metal nitrite, alkali earth metal nitrate, and alkali earth metal nitrite.

3. A gas-generating composition according to claim 2, wherein the metal oxyacid salt is alkali metal nitrate, and the molar ratio of the ammonium perchlorate with respect to the alkali metal nitrate is between 0.8 and 1.2.

4. A gas-generating composition according to claim 2, wherein the metal oxyacid salt is alkali metal nitrite, and the molar ratio of the ammonium perchiorate with respect to the alkali metal nitrite is between 0.8 and 1.2.

5. A gas-generating composition according to claim 2, wherein the metal oxyacid salt is alkali earth metal nitrate, and the molar ratio of the ammonium perchlorate with respect to the alkali earth metal nitrate is between 1.6 and 2.4.

6. A gas-generating composition according to claim 2, wherein the metal oxyacid salt is alkali earth metal nitrite, and the molar ratio of the ammonium perchlorate with respect to the alkali earth metal nitrite is between 1.6 and 2.4.

7. A gas-generating composition according to claim 1, wherein the combusting component constitutes between 2 and 60 weight % of the sum of the ammonium nitrate, the metal oxyacid salt, the ammonium perchlorate, and the combusting component.

8. A gas-generating composition according to claim 1, wherein the metal oxyacid salt is potassium nitrate, and said ammonium nitrate is phase-stabilized ammonium nitrate, which is phase-stabilized by using said potassium nitrate.

9. A gas-generating composition according to claim 1, wherein the oxygen-balance value of the gas-generating composition is between −0.1 and +0.1 (g/g).

10. A gas-generating composition for vehicle passenger protecting device, comprising:

(a) phase-stabilized ammonium nitrate having an average particle size between 1 and 1000 μm;

(b) potassium nitrate having an average particle size between 1 and 1000 μm;

(c) ammonium perchlorate having an average particle size between 1 and 1000 μm; and (d) microcrystalline carbon powder having an average particle size between 1 and 500 μm, wherein the phase-stabilized ammonium nitrate constitutes between 50 and 97 weight % of the sum of the phase-stabilized ammonium nitrate, the potassium nitrate, and the ammonium perchlorate.

11. A gas-generating composition for vehicle passenger protecting device, consisting essentially of:

(a) phase-stabilized ammonium nitrate;

(b) potassium nitrate;

(c) ammonium perchlorate; and (d) microcrystalline carbon powder, wherein the phase-stabilized ammonium nitrate constitutes between 50 and 97 weight % of the sum of the phase-stabilized ammonium nitrate, the potassium nitrate, and the ammonium perchlorate.

12. A gas-generating composition for vehicle passenger protecting device, comprising:

(a) phase-stabilized ammonium nitrate having an average particle size between 1 and 1000 μm;

(b) nitrate of alkali metal or alkali earth metal having an average particle size between 1 and 1000 μm;

(c) ammonium perchlorate having an average particle size between 1 and 1000 μm; and (d) microcrystalline carbon powder having an average particle size between 1 and 500 μm, wherein the phase-stabilized ammonium nitrate constitutes between 50 and 97 weight % of the sum of the phase-stabilized ammonium nitrate, the nitrate, and the ammonium perchlorate.

13. A gas-generating composition for vehicle passenger protecting device, comprising:

(a) phase-stabilized ammonium nitrate having an average particle size between 1 and 1000 μm;

(b) nitrate of alkali metal or alkali earth metal having an average particle size between 1 and 1000 μm;

(c) ammonium perchlorate having an average particle size between 1 and 1000 μm; and (d) microcrystalline carbon powder having an average particle size between 1 and 500 μm.

14. A gas-generating composition consisting essentially of:

(a) ammonium nitrate;

(b) metal oxyacid salt which produces a basic substance in combustion;

(c) ammonium perchlorate;

(d) at least one kind of combusting component selected from the group consisting of polymer binder, energetic material, and microcrystalline carbon powder, wherein the ammonium nitrate constitutes between 50 and 97 weight % of the sum of the ammonium nitrate, the metal oxyacid salt, and the ammonium perchlorate; and (a) at least one of
a stabilizer, and
a combustion catalyst.

15. The gas-generating composition according to claim 10, further comprising:

(e) at least one of;
a stabilizer, and
a combustion catalyst.

* * * * *